US005368439A

United States Patent [19]

Piazza

[11] Patent Number: 5,368,439

[45] Date of Patent: Nov. 29, 1994

[54] MAGNETIC DRIVE PUMP WITH AXIALLY ADJUSTABLE IMPELLER

[75] Inventor: Robert W. Piazza, Petaluma, Calif.

[73] Assignee: Price Pump Manufacturing Company, Sonoma, Calif.

[21] Appl. No.: 134,712

[22] Filed: Oct. 12, 1993

[51] Int. Cl.[5] ..... F01D 7/00

[52] U.S. Cl. ..... 415/131; 417/423.11

[58] Field of Search ..... 417/423.11, 423.7, 420, 417/129; 415/131, 140

[56] References Cited

U.S. PATENT DOCUMENTS

| | | | |
|---|---|---|---|
| 1,856,610 | 5/1932 | Wintroath | 415/131 |
| 3,386,385 | 6/1968 | Bartheld et al. | 415/131 |
| 4,130,374 | 12/1978 | Bingler | 415/131 |
| 4,417,849 | 11/1983 | Morris | 415/131 |
| 4,439,096 | 3/1984 | Rockwood et al. | 415/131 |

FOREIGN PATENT DOCUMENTS

| | | | |
|---|---|---|---|
| 4108257 | 9/1991 | Germany | 417/420 |
| 0379738 | 9/1932 | United Kingdom | 417/423.11 |

*Primary Examiner*—Edward K. Look
*Assistant Examiner*—Mark Sgantzos
*Attorney, Agent, or Firm*—Glen R. Grunewald

[57] ABSTRACT

Magnetic pump apparatus with a pump housing including a volute and having a pump housing interior at least partially defined by the volute. A support shaft is mounted in the pump housing interior. An impeller is supported on the support shaft and rotatably mounted in the pump housing interior. The position of the impeller relative to the volute can be adjusted when the impeller is supported on the support shaft and in the pump housing interior.

8 Claims, 2 Drawing Sheets

MAGNETIC DRIVE PUMP WITH AXIALLY ADJUSTABLE IMPELLER

TECHNICAL FIELD

This invention relates to a magnetic drive pump and, more particularly, to magnetic drive pump apparatus allowing adjustment of the impeller relative to the volute.

BACKGROUND ART

It is known in the pump art to provide magnetic drive pumps incorporating a housing completely enclosing the impeller and related structure. That is, no rotating shaft portions extend completely through the housing, eliminating the need for seals or packings of the type required in conventional pumps wherein the shaft extends through the housing at at least one end thereof. Consequently, all adjustments in the positioning of an impeller within the housing must be made prior to final assembly of the pump.

In the case of magnetically driven, sealess pumps of the type just described, a shoulder on the center of the impeller bears against the housing. The end of the impeller support shaft remote from the impeller is conventionally simply fixed at a preselected position within the pump housing, for example at the housing structure portion accommodating the driven magnetic structure of the pump. The clearance between the impeller and the volute is therefore fixed in such prior art arrangements. Pump efficiency is very sensitive to clearance between the impeller and the volute of the pump housing and prior art magnetically driven, sealess pumps constructed as just described have widely varying efficiencies when they come out of the factory door. Of course, the user of the pump has no way to conveniently adjust impeller placement because of the sealed nature of the pump device.

DISCLOSURE OF INVENTION

The apparatus of the present invention allows adjustment of a magnetic drive pump impeller relative to the pump housing volute to precise tolerances before the pump is fully assembled. Thus, all magnetic drive pumps constructed in accordance with the teachings of the present invention will be of a uniform character insofar as clearance between the impeller and volute is concerned. Such adjustment is readily effected during manufacture and the apparatus for accomplishing same is of relatively simple, inexpensive construction.

The magnetic drive pump apparatus of the present invention incorporates a pump housing including a volute and having a pump housing interior at least partially defined by the volute.

A support shaft is mounted in the pump housing interior.

An impeller supported on the support shaft is rotatably mounted in the pump housing interior.

Adjustment means is provided in operative association with the impeller to adjust the position of the impeller relative to the volute when the impeller is supported on the support shaft and in the pump housing interior.

The invention also includes lock means for locking the impeller against movement either toward or away from the volute after adjustment of the position of the impeller relative to the volute by the adjustment means.

The adjustment means includes a threaded element threadedly engaged with the support shaft and biasing means. The biasing means is operatively associated with the threaded element and the impeller to apply a biasing force against the impeller to bias the impeller relative to the volute when the threaded element is threadedly engaged with the support shaft.

The biasing means disclosed herein comprises a wave spring disposed about the support shaft.

Other features, advantages, and objects of the present invention will become apparent with reference to the following description and accompanying drawings.

BEST MODE FOR CARRYING OUT THE INVENTION

Figure 1:
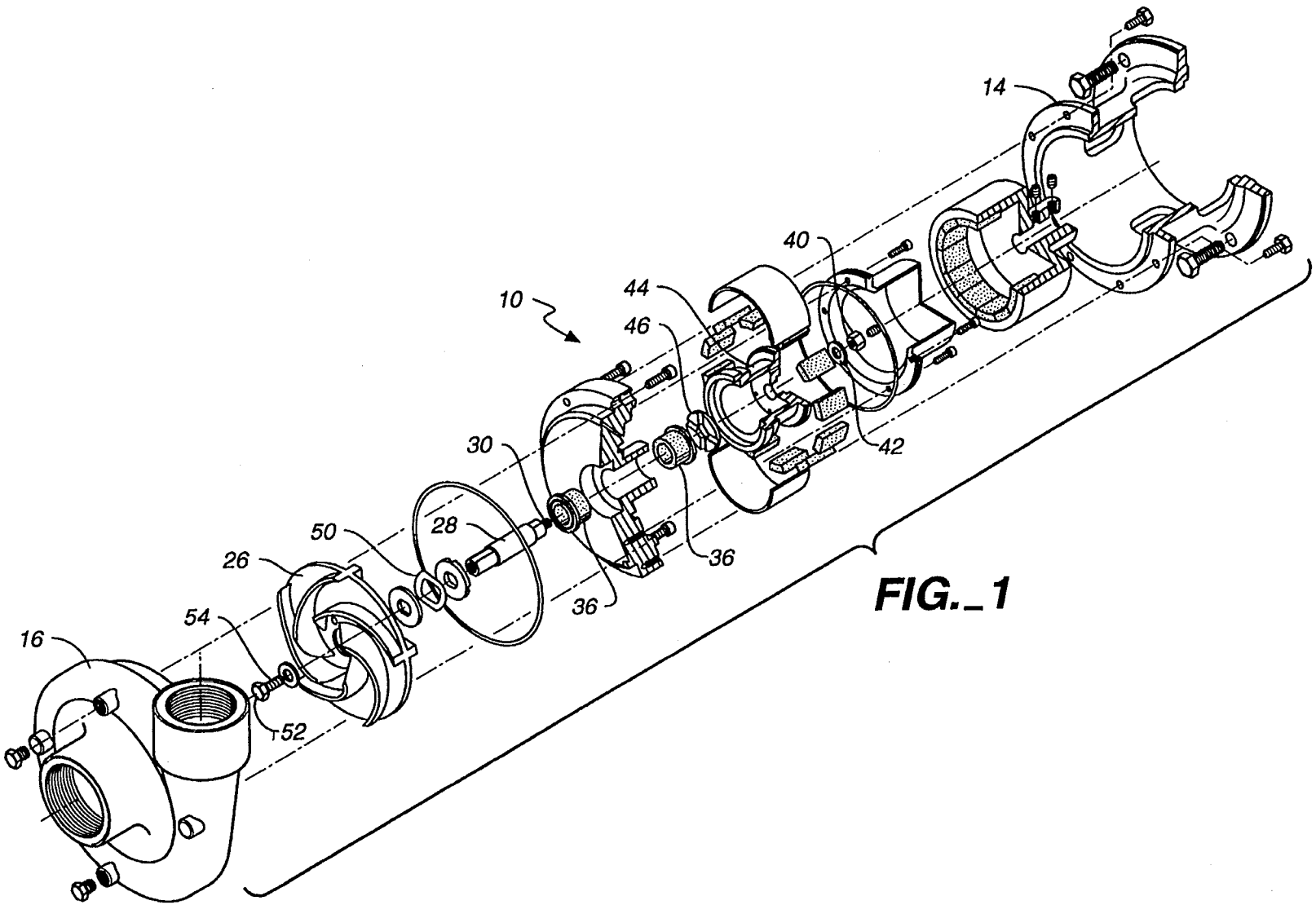
FIG. 1 is an exploded, perspective view of a pump constructed in accordance with the teachings of the present invention.
Figure 2:
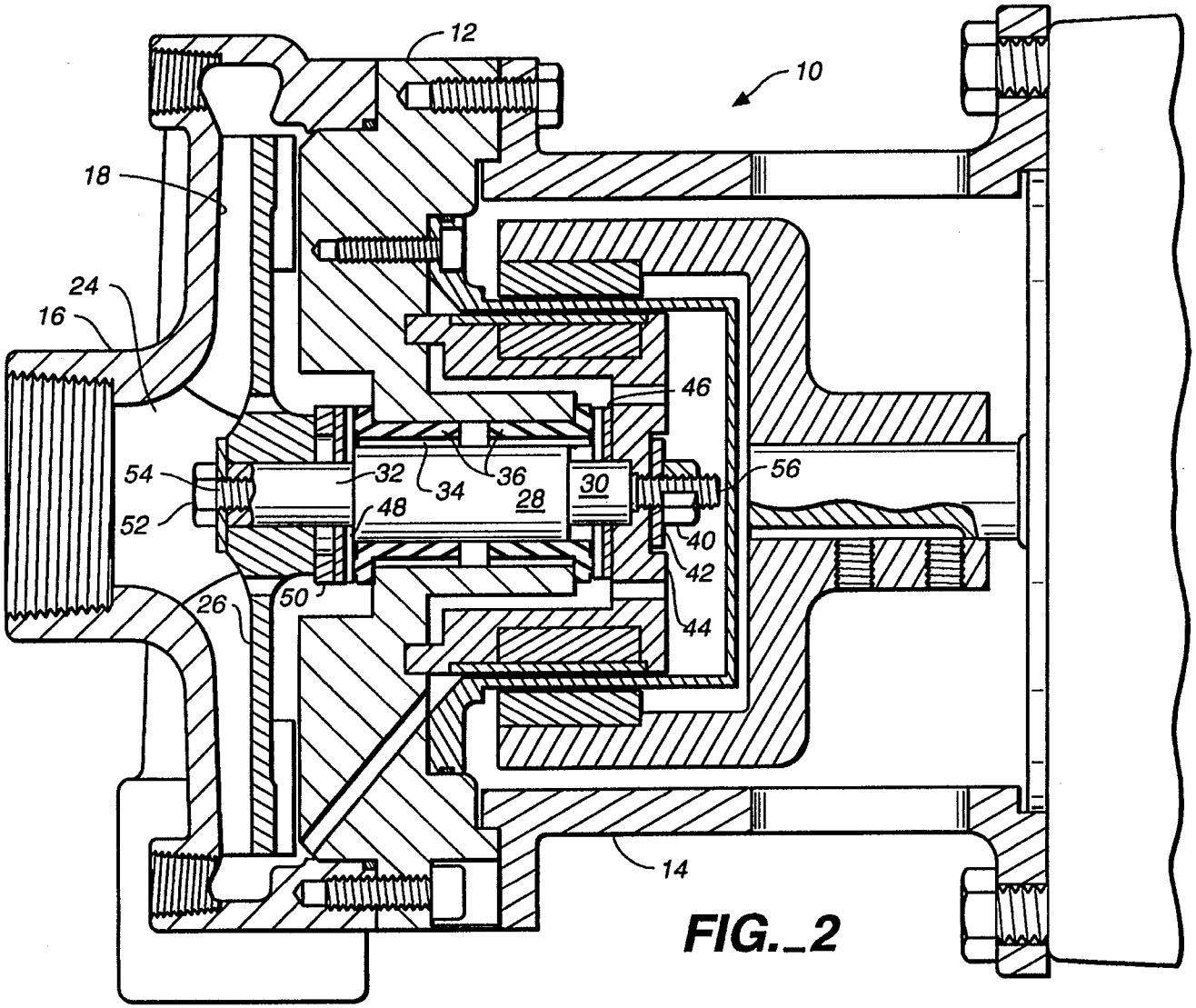
FIG. 2 is an enlarged, cross-sectional, side view of a segment of the assembled pump.

Referring now to the drawings, magnetic drive pump apparatus constructed in accordance with the teachings of the present invention is designated generally by reference numeral 10. Most of the magnetic drive pump is of conventional construction and will not be described. Only the structure pertinent to the present invention is discussed below.

Apparatus 10 includes a housing 12 having housing segments 14, 16. Housing segment 16 includes a volute inner wall 18. A housing interior 24 is defined at one end of the apparatus by the volute inner wall.

Disposed within housing interior 24 is a rotary impeller 26 which is supported by a support shaft 28. Support shaft 28 is externally threaded at the end 30 thereof remote from impeller 26. The support shaft 28 is internally threaded at the other end 32 thereof accommodating impeller 26.

The support shaft 28 is accommodated within the throughbore 34 of a two-part bushing 36.

A nut 40 is threadedly engaged to support shaft 28 at end 30 thereof. Nut 40 is in engagement with a washer 42 disposed about the support shaft end 30. In turn, washer 42 engages the end of the magnetic drive housing 44 employed to magnetically drive the impeller.

A thrust washer 46 which may, for example, be constructed of ceramic material, is disposed about support shaft 28 and between magnetic drive housing 44 and bushing 36.

A second thrust washer, thrust washer 48 which also may suitably be constructed of ceramic material, is located on support shaft 28 at the other end of bushing 36.

Sandwiched between thrust washer 48 and impeller 26 is biasing means in the form of a wave spring washer 50 defining convolutions at the opposed sides thereof.

The impeller 26 is held onto support shaft 28 by a stop element which, in a disclosed embodiment, comprises the enlarged head 52 of a bolt 54 threadedly secured to end 32 of support shaft 28. In the arrangement illustrated, a washer is disposed between the bolt head 52 and the impeller.

Prior to complete assembly of housing 12, with the apparatus of the present invention it is a relatively easy matter to adjust the clearance between the impeller and the housing volute. Such adjustment is readily accomplished merely by turning the adjusting nut 40 clockwise or counter-clockwise relative to the support shaft. The wave spring 50 exerts a continuous biasing force against the impeller but allows some degree of movement of the support shaft and the impeller relative to the housing so that the clearance between the volute and the impeller can be finely tuned before the pump goes out the factory door.

Once the impeller has been adjusted to a predetermined degree by turning the nut 40, a set screw 56 in nut 40 can be tightened against the support shaft 28 to lock the nut 40 into position.

I claim:

1. Magnetic drive pump apparatus, said apparatus comprising, in combination:

a pump housing including a volute and having a pump housing interior at least partially defined by said volute;

a support shaft mounted in a bushing in said pump housing interior and defining a through bore accommodating said support shaft with said support shaft being both axially and rotatably movable relative to said bushing;

an impeller supported on said support shaft and rotatably mounted in said pump housing interior; and adjustment means including an element threadedly engaged with said support shaft and biasing means positioned with said bushing between said biasing means and said threaded element, whereby rotational movement of said threaded element relative to said support shaft effects axial movement of said support shaft relative to said bushing and movement of said impeller relative to said volute.

2. The apparatus according to claim 1 additionally comprising lock means for locking said impeller against movement both toward and away from said volute after adjustment of the position of said impeller relative to said volute by said adjustment means.

3. The apparatus according to claim 1 additionally comprising a stop element connected to said support shaft at a location spaced from said threaded element, said threaded element and said stop element being disposed at opposed sides of said impeller and said biasing means being positioned between said threaded element and said stop element.

4. The apparatus according to claim 3 wherein said threaded element, said stop element, and said biasing means are cooperable with said impeller to prevent axial slidable movement of said impeller along said support shaft by clamping said impeller at a selected location on said support shaft.

5. The apparatus according to claim 1 wherein said biasing means comprises a wave spring disposed about said support shaft.

6. The apparatus according to claim 1 additionally comprising a first thrust washer disposed about said support shaft between said threaded element and said bushing and a second thrust washer between said bushing and said wave spring.

7. The apparatus according to claim 3 wherein said stop element comprises a second threaded element threadedly engaged with said support shaft.

8. The apparatus according to claim 1 wherein said biasing means is in engagement with said impeller.

* * * * *